US006279575B1

(12) United States Patent
Belloni

(10) Patent No.: US 6,279,575 B1
(45) Date of Patent: Aug. 28, 2001

(54) REGULATOR WITH BYPASS TUBE

(75) Inventor: Alberto Belloni, Recco (IT)

(73) Assignee: HTM Sport S.P.A. (IT)

( * ) Notice: Subject to any disclaimer, the term of this patent is extended or adjusted under 35 U.S.C. 154(b) by 0 days.

(21) Appl. No.: 09/253,144

(22) Filed: Feb. 19, 1999

(30) Foreign Application Priority Data

Feb. 20, 1998 (IT) ..... GE98A0007

(51) Int. Cl.[7] ..... A62B 9/02

(52) U.S. Cl. ..... 128/205.24; 128/204.26; 128/204.27

(58) Field of Search ..... 128/204.25, 204.26, 128/205.24, 204.27, 204.28

(56) References Cited

U.S. PATENT DOCUMENTS

| | | | | |
|---|---|---|---|---|
| Re. 31,785 | * | 1/1985 | Netteland | 128/204.26 |
| 2,121,311 | * | 6/1938 | Anderson et al. | 128/204.26 |
| 2,387,123 | * | 10/1945 | Deming | 128/204.26 |
| 2,663,121 | * | 12/1953 | Ramsey | 137/494 |
| 2,755,799 | * | 7/1956 | Marty | 128/204.26 |
| 2,843,120 | * | 7/1958 | Thauer et al. | 128/204.26 |
| 2,854,972 | | 10/1958 | Cummins . | |
| 3,095,890 | | 7/1963 | Cousteau et al. . | |
| 3,468,307 | * | 9/1969 | Cummins | 128/204.24 |
| 3,570,808 | | 3/1971 | Wrenn . | |
| 3,978,854 | | 9/1976 | Mills, Jr. . | |
| 3,991,785 | * | 11/1976 | Trinkwalder, Jr. | 137/494 |
| 4,002,166 | | 1/1977 | Oliver . | |
| 4,066,076 | * | 1/1978 | Williamson | 128/204.26 |
| 4,219,017 | | 8/1980 | Shamlian et al. . | |
| 4,253,455 | * | 3/1981 | Netteland | 128/204.26 |
| 4,616,645 | * | 10/1986 | Pedersen et al. | 128/204.26 |
| 4,796,618 | | 1/1989 | Garraffa . | |
| 5,042,473 | | 8/1991 | Lewis . | |
| 5,701,890 | * | 12/1997 | Pietrelli | 128/205.24 |
| 5,724,961 | * | 3/1998 | Tistrand | 128/205.24 |

FOREIGN PATENT DOCUMENTS

| | | |
|---|---|---|
| 0 759 314 | 2/1997 | (EP) . |
| 2 028 142 | 3/1980 | (GB) . |
| 95-12519 | 5/1995 | (WO) . |

OTHER PUBLICATIONS

Bailar et al., Chemistry 2d ed. pp. 96–99 & 106 Academic Press, Dec. 1984.*

McPherson et al., Respiratory Therapy Equipment, pp. 22–29 C. V. Mosby Co., Dec. 1981.*

* cited by examiner

*Primary Examiner*—John G. Weiss
*Assistant Examiner*—Joseph F. Weiss, Jr.
(74) *Attorney, Agent, or Firm*—Larson & Taylor, PLC

(57) ABSTRACT

A regulator includes a box-like body containing a device for regulating the flow of air. A tube connected to the box-like body carries a mouthpiece. An air inlet hose is connected to the box-like body by means of an inlet valve. This valve is controlled by the regulating device. One or more exhaust hoses are connected to the box-like body. A tube formed integrally within the box-like body of the regulator bypasses the chamber of the regulating device.

5 Claims, 3 Drawing Sheets

REGULATOR WITH BYPASS TUBE

BACKGROUND OF THE INVENTION

1. Field of the Invention

The present invention relates to regulators for underwater breathing apparatus, in particular to regulators having a tube which bypasses the chamber of the air-flow regulating device.

2. Description of the Related Art

Regulators of this type are known in the art and consist, as described for example in U.S. Pat. No. 4,002,166, of a regulator comprising a box-like body containing an air-flow regulating device which is connected to an air inlet hose by means of a suitable valve controlled by the said regulating device and in which, downstream of the valve, a tube draws the air from the inlet hose and conveys it directly to a mouthpiece tube, thereby bypassing the chamber of the flow regulating device.

This type of bypass system was designed with the aim of making regulator operation easier. This is achieved because, by bypassing the chamber of the regulating device, a pressure drop is created in a known manner inside the chamber and this reduces the effort the diver needs to exert in order to inhale since the diaphragm in the regulating device is subjected to a pressure difference that allows it, via a lever, to act on the air inlet valve such that it opens the inlet hose.

Regulators of the type described above with reference to U.S. Pat. No. 4,002,166 nevertheless have certain disadvantages: the bypass tube through which the air is conveyed from the inlet hose to the mouthpiece is actually outside the box-like body of the regulator, which means that the mouthpiece tube and the air inlet hose need to be fitted with suitable connecting and sealing means in order to be coupled to the bypass tube, all of which does nothing for the structural compactness of the regulator.

SUMMARY OF THE INVENTION

The object of the present invention is therefore to provide a regulator in which the air bypass tube is formed integrally within the box-like body of the said regulator, for example by moulding the box-like body if the latter is made of plastic, thereby avoiding the need for an external bypass tube fitted with sealing and connecting means.

This object is achieved by means of a regulator having a bypass tube comprising: a box-like body containing the device for regulating the flow of air; a tube connected to this box-like body onto which the mouthpiece is attached; an air inlet hose connected to the box-like body by means of an inlet valve which is controlled by the regulating device; one or more exhaust hoses formed in the box-like body; and a bypass tube which connects the inlet hose with the mouthpiece tube, in which this bypass tube is formed integrally within the box-like body of the regulator.

BRIEF DESCRIPTION OF THE DRAWINGS

A better understanding of the invention will be gained by referring to the description of the following embodiments which are given by way of non-limiting example and are illustrated in the appended drawings, in which.

DESCRIPTION OF THE PREFERRED EMBODIMENTS

Figure 1:
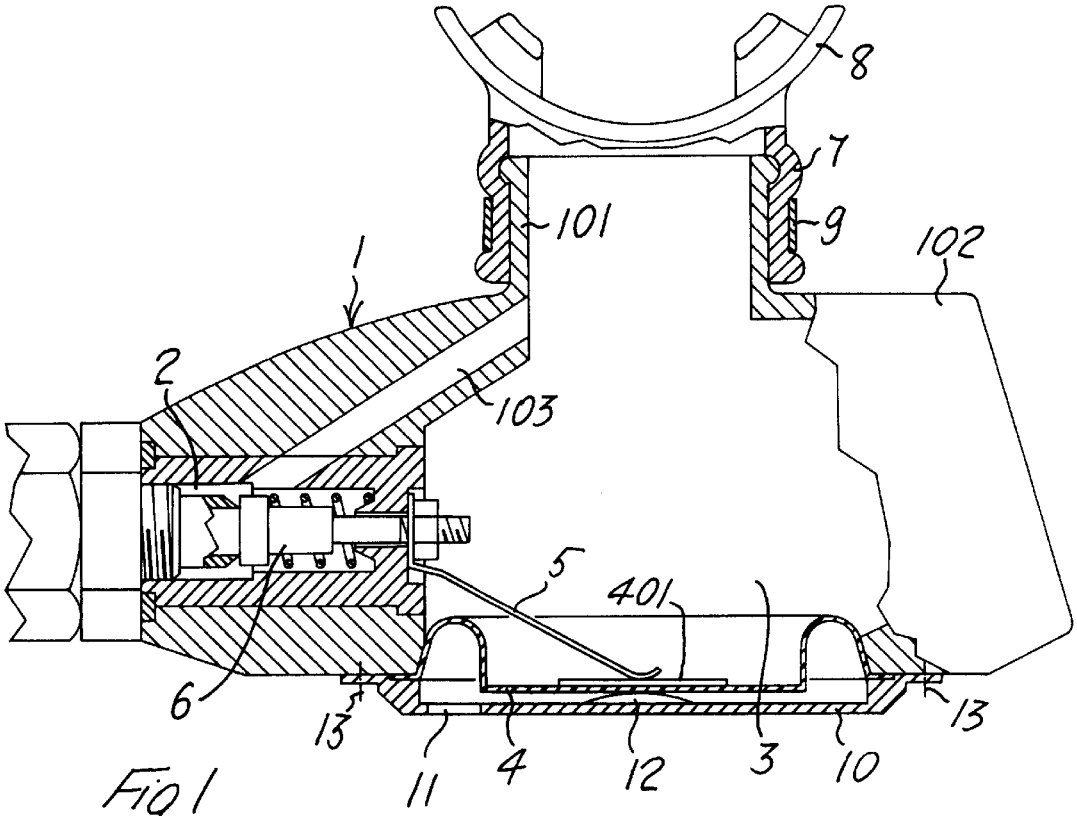
FIG. 1 is a view from above in partial cross-section of a first embodiment of the regulator of the present invention.

FIG. 1 illustrates a first embodiment of the regulator for underwater breathing apparatus which is fitted with the bypass tube of the present invention. As may be seen, this regulator comprises: a box-like body 1 which can advantageously be made of plastic and which contains a device (3, 4, 5, 6) for regulating the flow of air arriving via an inlet hose 2. This regulating device essentially consists of a chamber 3 having a diaphragm 4 located at the opposite end of the box-like body 1 to the end with the mouthpiece 8; as a result of the pressure difference that is created when the diver inhales, this diaphragm 4 actuates the lever 5, which is coupled in a known manner to the air-flow regulating valve 6, such that the valve 6 opens the inlet hose 2. The box-like body 1 also comprises an integral tube 101 which couples up with the connector 7 on the mouthpiece 8, this connector 7 being advantageously made of an elastomeric material and being fitted with a sealing ring 9 in order to ensure that the regulator is fully leaktight. The box-like body 1 also comprises an exhaust hose 102, located to the side of the diver's mouthpiece 8, and a bypass tube 103 formed integrally within the box-like body 1, for example by moulding the plastic that forms the said box-like body. As may be seen in the figure, the tube 103 draws air downstream of the regulating valve 6 and conveys it directly to the tube 101 of the mouthpiece 8, thereby bypassing the chamber 3 and creating a pressure drop therein which makes it easier for the rigid part 401 of the diaphragm 4 to act on the lever 5. The regulator also comprises a rigid cover 10 over the diaphragm 4, this cover having an aperture 11 so that the diaphragm 4 can communicate with the surrounding water in order that the pressure difference needed for the regulating device to work is created across the diaphragm 4. In this embodiment the cover 10 is fixed to the box-like body 1 by means of pins 13 and, since the ends of the diaphragm 4 are inserted between the box-like body 1 and the cover 10, this ensures that the breathing apparatus is completely leaktight. The regulator also has a conventional purge and control button 12.

As may further be seen in FIG. 1, by virtue of the solution provided by the present invention—i.e. forming the bypass tube 103 integrally within the box-like body 1—the overall form of the regulator is advantageously compact.

Figure 2:
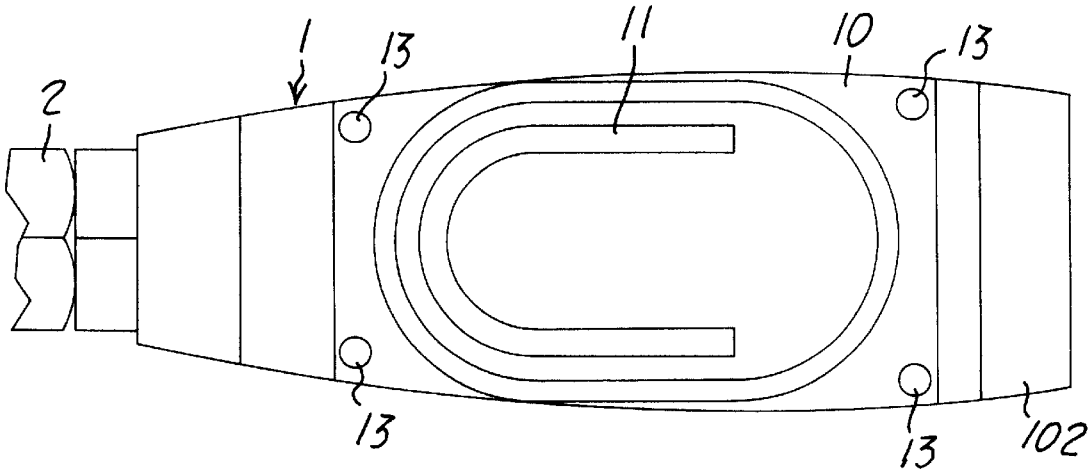
FIG. 2 is a front view of the embodiment of FIG. 1.

FIG. 2 illustrates the embodiment of the present invention described above, showing the pins 13 for fixing the cover 10 and the approximately semi-elliptical shape of the aperture 11.

Figure 3:
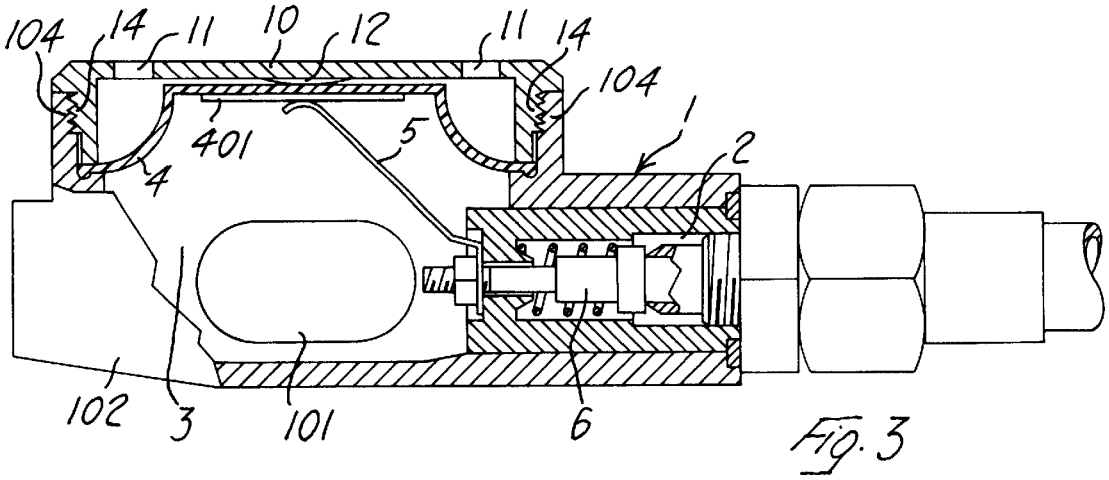
FIG. 3 is a side view in partial cross-section of a second embodiment of the present invention.
Figure 4:
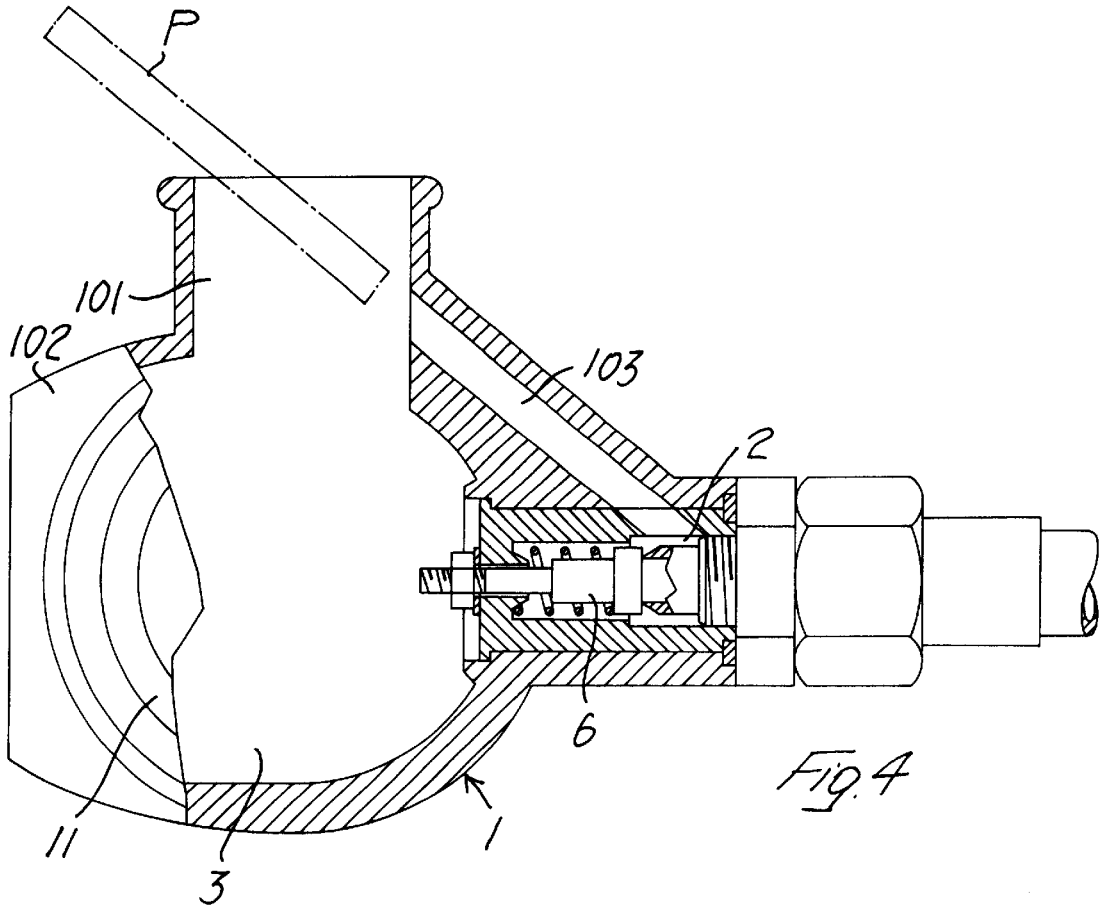
FIG. 4 is a view from above in partial cross-section of the embodiment of FIG. 3.

FIGS. 3 and 4 illustrate a second embodiment of the present invention, in which the diaphragm 4 is located at the top relative to the tube 101 of the mouthpiece 8 and lateral to the exhaust hose 102. In addition, the box-like body 1 has a threaded connector 104 onto which the threaded part 14 of the cover 10 is screwed. In this embodiment, the aperture 11 in the cover 10 which allows the diaphragm 4 to communicate with the external surroundings is circular in shape.

Figure 6:
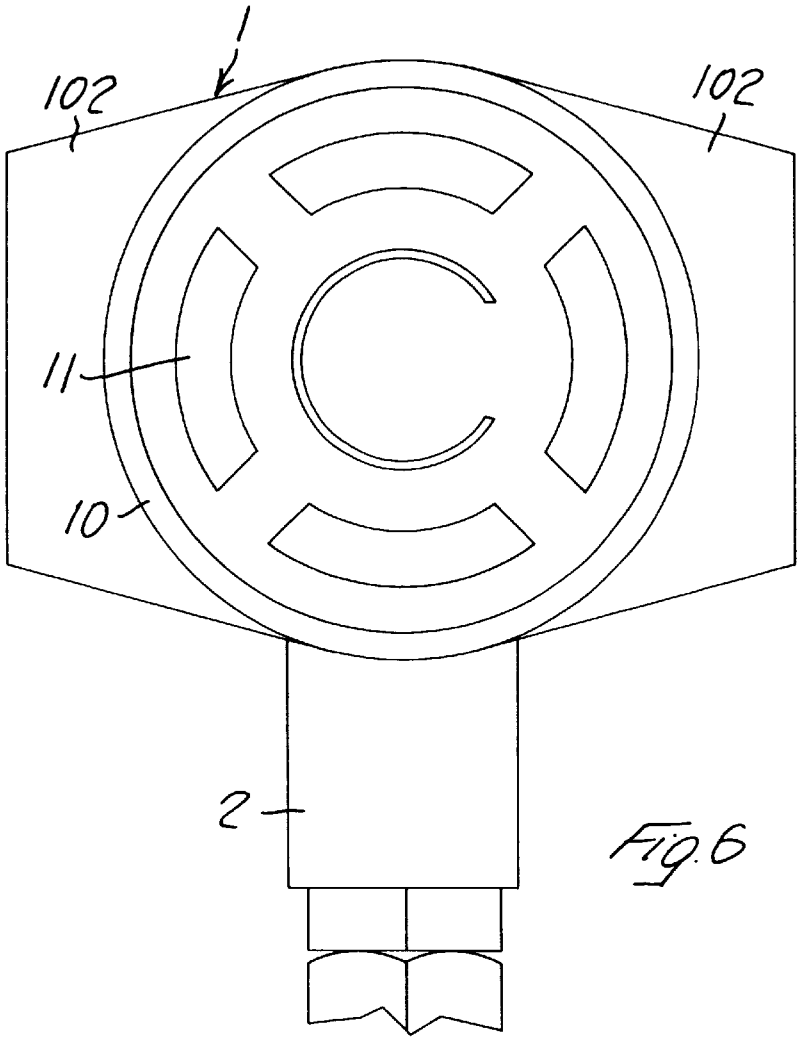
FIG. 6 is a front view of the embodiment of FIG. 5.
Figure 5:
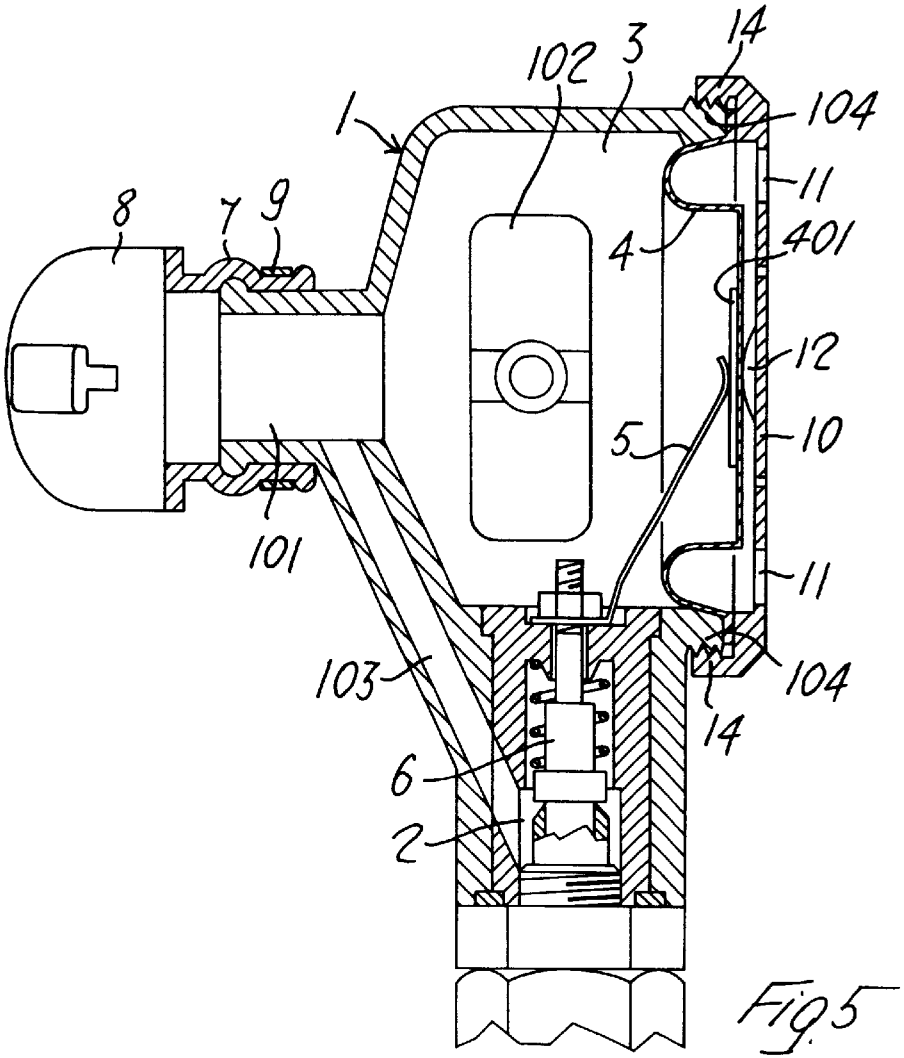
FIG. 5 is a view from above in partial cross-section of a third embodiment of the present invention.

FIG. 5 shows a further embodiment of the regulator of the present invention, in which the diaphragm 4 is located opposite the mouthpiece 8, which is positioned centrally relative to two exhaust hoses 102 formed integrally within the box-like body 1. As may be seen from the figure, in this embodiment too the threaded part 14 of the cover 10 is screwed onto the threaded connector 104 of the box-like body 1, while the apertures 11 are of a particular shape (FIG. 6).

As further shown in FIG. 5, the bypass tube 103 is inclined at such an angle with respect to the chamber 3 so as to direct the air straight to the mouthpiece zone 101, thus by-passing the chamber 3. Furthermore, the angle of inclination of said bypass tube 103 is such as to permit to form the bypass tube 103 directly in the mold, by means of a peg P which may be inserted both from the side of the tube 101 of the mouthpiece 8 and/or from the side of the inlet hose 2.

As will have been deduced from the detailed description above which refers to the appended drawings, numerous embodiments may be adopted for the regulator of the present invention, the latter not being restricted to those cited by way of non-limiting example, with each of the embodiments achieving the object of the present invention—i.e. to provide a conventional regulator with a chamber bypass tube which is formed integrally within the box-like body of the regulator, offering the advantages that derive therefrom, as described.

What is claimed is:

1. A regulator comprising:

a body having a first end and a second end;

a chamber in said body, said chamber containing a regulating device for regulating flow of air;

a mouthpiece tube connected to the first end of the body and carrying a mouthpiece, said mouthpiece being positioned on the tube;

an air inlet hose connected to the body by means of an inlet valve, the valve being controlled by the regulating device;

a diaphragm for actuating the regulating device when a user inhales;

at least one exhaust hose connected to the body; and a bypass tube which bypasses the chamber of the body, the bypass tube being formed integrally within the body of the regulator, said bypass tube being contiguous such that all air entering said inlet hose flows directly into said mouthpiece tube bypassing an interior of the chamber, thereby creating a pressure drop in the chamber allowing less pressure on the diaphragm making it easier for the user to breathe.

2. The regulator according to claim 1, wherein said body is made of plastics and the bypass tube is formed by moulding the body.

3. The regulator according to claim 1, wherein the diaphragm is located at the second end of the body opposite the mouthpiece and laterally adjacent to the at least one exhaust hose, the diaphragm including a cover secured to the body by means of pins.

4. The regulator according to claim 1, wherein the diaphragm is located at the first end of the body, adjacent to the mouthpiece and to the at least one exhaust hose, the diaphragm including a cover having a threaded part which is screwed onto a threaded connector of the body.

5. The regulator according to claim 1, comprising at least two exhaust hoses and the diaphragm is located at the second end of the body opposite the mouthpiece and centrally relative to said two exhaust hoses which are positioned on either side, adjacent to the diaphragm, the diaphragm including a cover screwed by means of a threaded part onto a threaded connector of the body.

* * * * *